US009481845B2

(12) United States Patent
Dolmazon et al.

(10) Patent No.: US 9,481,845 B2
(45) Date of Patent: Nov. 1, 2016

(54) USE OF COMPOUNDS REVEALING THE EFFICIENCY OF FILTERABILITY ADDITIVES IN HYDROCARBON DISTILLATES, AND SYNERGIC COMPOSITION CONTAINING SAME

(75) Inventors: Nelly Dolmazon, Serezin (FR); Laurent Dalix, Saint Just Chaleyssin (FR); Erwan Chevrot, Saint Priest (FR); Frédéric Tort, Brignais (FR)

(73) Assignee: Total Raffinage Marketing, Puteaux (FR)

( * ) Notice: Subject to any disclaimer, the term of this patent is extended or adjusted under 35 U.S.C. 154(b) by 1416 days.

(21) Appl. No.: 12/373,261

(22) PCT Filed: Jul. 6, 2007

(86) PCT No.: PCT/FR2007/001153

§ 371 (c)(1),
(2), (4) Date: Sep. 8, 2009

(87) PCT Pub. No.: WO2008/006965

PCT Pub. Date: Jan. 17, 2008

(65) Prior Publication Data

US 2010/0058653 A1 Mar. 11, 2010

(30) Foreign Application Priority Data

Jul. 10, 2006 (FR) ..... 06 06254

(51) Int. Cl.

| | |
|---|---|
| ***C10L 1/197*** | (2006.01) |
| ***C10L 10/16*** | (2006.01) |
| ***C10L 1/14*** | (2006.01) |
| ***C10L 1/195*** | (2006.01) |
| ***C10L 10/14*** | (2006.01) |
| *C10L 1/196* | (2006.01) |

(52) U.S. Cl.

CPC ..... *C10L 10/16* (2013.01); *C10L 1/146* (2013.01); *C10L 1/195* (2013.01); *C10L 10/14* (2013.01); *C10L 1/1963* (2013.01); *C10L 1/1973* (2013.01)

(58) Field of Classification Search

CPC ..... C10L 1/1973; C10L 1/146

USPC ..... 44/395

See application file for complete search history.

(56) References Cited

U.S. PATENT DOCUMENTS

| | | | | |
|---|---|---|---|---|
| 3,275,427 | A | 9/1966 | Brownawell et al. | |
| 3,726,653 | A | 4/1973 | Van der Meij et al. | |
| 4,153,422 | A | 5/1979 | Wisotsky | |
| 4,261,703 | A * | 4/1981 | Tack | C10L 1/146 44/318 |
| 2004/0010072 | A1 * | 1/2004 | Krull et al. | 524/523 |

FOREIGN PATENT DOCUMENTS

| | | | |
|---|---|---|---|
| CA | 202571 | A1 * | 1/1991 |
| CA | 2020571 | * | 1/1991 |
| CH | 546715 | A | 3/1974 |
| EP | 0406684 | * | 1/1991 |
| EP | 0406684 | A1 | 1/1991 |
| EP | CA2020571 | A1 * | 1/1991 |
| EP | 1391498 | A | 2/2004 |
| JP | 06192666 | A | 7/1994 |

OTHER PUBLICATIONS

Machine Translation of EP0406684.*

* cited by examiner

*Primary Examiner* — Ellen McAvoy
*Assistant Examiner* — Ming Cheung Po
(74) *Attorney, Agent, or Firm* — Harness, Dickey & Pierce, P.L.C.

(57) ABSTRACT

The invention relates to the use, in a hydrocarbon distillate with a boiling temperature of between 150 and 450° C. and a crystallization onset temperature as measured by Differential Calorimetric Analysis of greater than or equal to −50° C., preferably of −5° C. to +10° C., of a homopolymer obtained from an olefinic ester of carboxylic acid of 3 to 12 carbon atoms and from a fatty alcohol containing a chain of more than 16 carbon atoms and optionally an olefinic double bond, as a compound for revealing the efficiency of filterability additives based on copolymer and/or terpolymers of ethylene and of vinyl ester of a carboxylic acid of 3 to 12 carbon atoms, and of a monoalcohol containing 1 to 10 carbon atoms. The invention is also directed to an additive composition comprising a conventional hydrocarbon filterability additive in combination with an efficiency reveal additive, and also to the combustion fuels, motor fuel and oil fuel that comprise these additive combinations.

10 Claims, No Drawings

USE OF COMPOUNDS REVEALING THE EFFICIENCY OF FILTERABILITY ADDITIVES IN HYDROCARBON DISTILLATES, AND SYNERGIC COMPOSITION CONTAINING SAME

CROSS-REFERENCE TO RELATED APPLICATIONS

This application is a National Phase Entry of International Patent Application No. PCT/FR2007/001153, filed Jul. 6, 2007, claiming priority to French Patent Application No. FR 06/06254, filed Jul. 10, 2006, both of which are incorporated by reference herein.

BACKGROUND AND SUMMARY

The invention relates to the use in hydrocarbon distillates, for which the onset crystallization temperature of paraffins is greater or equal to −5° C., of an agent revealing the efficiency of conventional additives for filterability of hydrocarbons, as regards the limiting filterability temperature of these distillates and of their flow temperature at low temperatures. The invention is also directed to an additive composition comprising a standard additive for filterability of hydrocarbons in combination with an efficiency revealing agent as well as to combustion fuels, fuel and fuel oil comprising these combinations of additives.

The petroleum industry has been developing for a long time additives promoting filterability of fuels at low temperatures. These additives, called LFT (Limiting Filterability Temperature) additives, have the role of limiting the size of the crystals of the formed paraffins so that they may pass through the filters positioned inside internal combustion engines or in heating installations. This type of additives, very widely known to one skilled in the art, is systematically added to the middle distillates of conventional type used as diesel fuels or heating oil.

The prior art describes the use of other products having a synergic effect with the known filterability additives, notably polymers of ethylene and vinyl acetate and/or vinyl propionate, as regards the improvement in the limiting filterability temperature and flow temperature at low temperatures of hydrocarbon distillates of a conventional type. Thus, U.S. Pat. No. 3,275,427 describes a middle distillate from a cut of distillation comprised between 177 and 400° C. containing an additive consisting of 90 to 10% by weight of an ethylene copolymer comprising 10 to 30% of vinyl acetate units with a molecular weight comprised between 1,000 and 3,000 and of 10 to 90% by weight of a polylauryl acrylate and/or polylauryl methacrylate with a molecular weight ranging from 760 to 100,000. It is noted that these polyacrylates improve the filterability temperature determined according to the NF EN116 standard without deteriorating the flow point temperature as determined by the NF 60105 standard while the ethylene and vinyl acetate copolymer improves flow.

For the transport of crude oils and heavy distillates via pipeline, the authors of U.S. Pat. No. 3,726,653 were confronted with the improvement of flow notably at low temperatures at which these products might congeal in the pipelines. In order to improve these properties in hydrocarbon compositions containing paraffins, 5-20% by weight of which have a boiling point above 350° C. and a softening point above 35° C., the inventors proposed adding to these compositions 10 ppm to 2% by weight of a polymeric mixture of an olefinic ester of carboxylic acids with 3 to 5 carbon atoms with an alcohol with 14 to 30 carbon atoms and with a molecular weight ranging from 1,000 to 1,000,000, with a ethylene and vinyl acetate copolymer comprising from 1 to 40, preferably from 14 to 24 units of vinyl acetate with an average molecular weight of 20,000 to 60,000, the polymeric molar ratio of olefinic ester over ethylene and vinyl acetate copolymer ranging from 0.1 to 10:1.

In order to control the size of the crystals of paraffins present at contents less than 3% in middle distillates having a boiling point comprised between 120° and 480° C., the authors of U.S. Pat. No. 4,153,422 propose adding to these middle distillates 10 ppm to 1% by weight of a mixture of a homopolymer of an olefinic ester of acrylic or methacrylic acid comprising an alkyl chain with 14 to 16 carbon atoms and a molecular weight ranging from 1,000 to 200,000, with an ethylene and vinyl acetate copolymer with a number average molecular weight less than 4,000, the homopolymeric molar ratio of olefinic ester over ethylene and vinyl acetate copolymer ranging from 0.1:1 to 20:1. But, with the increasing variety of sources of middle distillates, the present middle distillates stemming from the mixture of these sources, such as diesel fuels and fuel oils, now have very different compositions from those of the middle distillates produced previously and for which the filterability additives notably those based on ethylene and vinyl acetate and/or ethylene and vinyl propionate copolymers, have been developed. Further, the change in specifications since the year 2000, and more recently in 2005, has led the refiner to distinctly formulate the distillates for use as diesel fuels in engines, and domestic fuel oils used in heating installations.

The distillates used are generally derived from more complex refining operations than those stemming from direct distillation of hydrocarbons, and may originate from cracking, hydrocracking and catalytic cracking methods and from viscosity breaking methods. With the increasing demand in diesel fuels, the refiner tends to want to introduce cuts which are more difficult to utilize, in these fuels, such as the heaviest cuts from these cracking and viscosity breaking methods which are loaded with heavy paraffins, i.e. comprising more than 18 carbon atoms. Further, synthetic distillates originating from transformation of gas such as those from the Fischer Tropsch method, but also those resulting from the treatment of biomass of vegetable or animal origin, such as notably NexBTL and the distillates comprising esters of vegetable or animal oils have appeared on the market and form a new range of products which may be used as a fuel base and/or domestic fuel oil base also comprising paraffinic chains with about 18 carbon atoms or more.

It was seen that the filterability temperature of the distillates obtained by combining the old bases and these new sources is improved with difficulty by adding a conventional filterability additive because of the significant presence of normal paraffins with more than 18 carbon atoms and in particular of the complex distribution of normal paraffins in their composition. Indeed, in these novel combinations of distillates, discontinuous paraffin distributions making the known filterability additives unsuitable were noticeable. Further, the arrival of novel crude oils was seen on the market, which are much richer in paraffins than those commonly refined and for which the filterability temperature of distillates from direct distillation was improved with difficulty by the conventional filterability additives in the same way as those mentioned earlier.

In the documents of the prior art, the authors therefore use combinations of alkylene vinyl ester polymers with vinyl polyesters in order to solve the majority of the problems for improving the flow point and the filterability temperature for distillates of a conventional type, and they do not give any indication for solving the specific problems associated with novel hydrocarbon distillates, for which the onset crystallization temperature of the paraffins is close to zero and/or the normal paraffin content containing more than 18 carbon atoms is larger than 4%. Therefore there is a need for adapting the filterability additives to these novel types of distillates.

Thus, this invention is not only applied to distillates stemming from direct distillation of hydrocarbons derived from crude oils which are very loaded with paraffins but also and especially to hydrocarbons derived from the heaviest cuts of refining operations, i.e. from cracking, hydrocracking, and catalytic cracking methods and viscosity breaking methods or further synthetic distillates stemming from transformation of gas such as those stemming from the Fischer Tropsch method, but also those resulting from the treatment of vegetable or animal biomass, such as notably NexBTL and the distillates containing esters of vegetable and/or animal oils, either taken alone or as a mixture. One of the routes selected by the applicant is that of improving the activity of conventional filterability additives as regards the limiting filterability temperature of middle distillates by adding another polymer as an agent for revealing the efficiency of the conventional filterability additives present in the middle distillate by producing a synergic effect.

For this purpose, the present invention proposes the use in a hydrocarbon distillate with a boiling temperature comprised between 150 and 450° C. and with an onset crystallization temperature, as measured by Differential Scanning Calorimetry Analysis greater than or equal to −5° C., preferably from −5° to +10° C., of a homopolymer obtained from an olefinic ester of a carboxylic acid with 3 to 12 carbon atoms and of a fatty alcohol comprising a chain with more than 16 carbon atoms and optionally an olefinic double bond, as a compound for revealing the efficiency of filterability additives based on a copolymer and/or terpolymer of ethylene and vinyl ester of a carboxylic acid with 3 to 5 carbon atoms and of a mono-alcohol comprising 1 to 10 carbon atoms. Preferably, the hydrocarbon distillate comprises a weight content of n-paraffins containing more than 18 carbon atoms, larger than 4%. Preferably, the hydrocarbon distillate comprises a weight content of n-paraffins larger than or equal to 0.7%, the carbon number of which is larger than 24, preferably a mixture from 0.7 to 2% by weight of n-paraffins having a carbon number ranging from $C_{24}$ to $C_{40}$.

According to one embodiment, the filterability additives are ethylene copolymers containing more than 20% of ester units. Preferably, the filterability additives are selected from copolymers of ethylene and vinyl acetate, of ethylene and vinyl propionate, of ethylene and of vinyl versatate, of ethylene and (alkyl)acrylates, of ethylene and (alkyl)methacrylates, either taken alone or as a mixture, comprising from 20 to 40% by weight of ester units. According to a preferred embodiment, said esters are of the vinyl acetate, vinyl priopionate, vinyl versatate, (alkyl)acrylate and (alkyl) methacrylate type, the alkyl group containing from 1 to 7 carbon atoms.

According to one embodiment, the homopolymer is obtained by polymerization of an olefinic ester of acrylic acid optionally substituted with an alkyl group having from 1 to 7 carbon atoms, and of an alcohol comprising more than 16 carbon atoms, preferably from 18 to 50 carbon atoms, the homopolymer having a weight average molecular weight Mw comprised between 5,000 and 20,000, preferably comprised between 10,000 and 19,000. According to a particular embodiment, the homopolymer is a polyacrylate comprising side hydrocarbon chains with from 18 to 40 carbon atoms. According to a particular embodiment, the distillate is selected from distillates with a boiling temperature comprised between 150 and 450° C., comprising distillates from direct distillation, in vacuo distillates, hydrotreated distillates, distillates stemming from catalytic cracking and/or hydrocracking of distillates in vacuo, the distillates resulting from conversion methods of the ARDS (atmospheric residue desulfurization) type and/or viscosity breaking methods, from valuation of Fischer Tropsch cuts, and distillates resulting from BTL conversion of vegetable and/or animal biomass, and distillates containing alkyl esters of vegetable or animal oils either taken alone or as a mixture.

According to another object, the invention relates to a composition comprising a mixture consisting of A) a filterability additive based on a copolymer and/or terpolymer of ethylene and of a vinyl ester of a carboxylic acid with 3 to 5 carbon atoms and of a mono-alcohol comprising 1 to 10 carbon atoms and B) a homopolymer of an olefinic ester of a carboxylic acid with 3 to 12 carbon atoms and of a fatty alcohol comprising more than 16 carbon atoms, A and B being in a ratio producing a synergic effect as regards the filterability temperature LFT as measured according to the NF EN116 standard, of hydrocarbon distillates with a boiling temperature comprised between 150 and 450° C. and with an onset crystallization temperature as measured by differential scanning calorimetry analysis, greater than or equal to −5° C., preferably from −5 to +10° C.

According to another object, the invention relates to a composition comprising (A) from 85 to 99% by weight of at least one filterability additive based on a copolymer and/or terpolymer of ethylene and of a vinyl ester of a carboxylic acid with 3 to 5 carbon atoms and of a mono-alcohol comprising from 1 to 10 carbon atoms, and (B) from 1 to 15% by weight of a homopolymer of an olefinic ester of a carboxylic acid with 3 to 12 carbon atoms and of a fatty alcohol comprising more than 16 carbon atoms. According to a particular embodiment of the composition, the homopolymer has a weight average molecular weight Mw comprised between 5,000 and 20,000, preferably comprised between 10,000 and 19,000. Preferably, the homopolymer is an olefinic ester of acrylic acid with an alcohol comprising from 18 to 50 carbon atoms. Preferably, the homopolymer is a polyacrylate comprising side hydrocarbon chains with 18 to 40 carbon atoms.

Preferably, in the composition according to the invention, the filterability additive is selected from copolymers and terpolymers of ethylene containing more than 20% of ester units, these ester units being themselves selected from esters of the vinyl acetate, vinyl propionate, alkyl acrylate and alkyl methacrylate type, taken alone or as a mixture, the alkyl group containing from 1 to 7 carbon atoms. According to a preferred embodiment, the filterability additives are selected from copolymers or terpolymers of ethylene and vinyl acetate, and/or of vinyl propionate, and/or of vinyl versatate, of ethylene and/or (alkyl)acrylates, and/or (alkyl) methacrylates taken alone or as a mixture, comprising from 20 to 40% by weight of ester units. According to a preferred embodiment, the filterability additives are selected from the copolymers or terpolymers of ethylene and vinyl acetate, and/or vinyl propionate and/or vinyl versatate, of ethylene and/or (alkyl)acrylates, and/or (alkyl)methacrylates, with a weight molecular weight comprised between 3,000 and 20,000. According to a preferred embodiment, the composition according to the invention comprises from 85 to 98% by weight of copolymers of ethylene and of vinyl acetate comprising from 20 to 30% by weight of vinyl acetate units and from 2 to 15% by weight of polyacrylate comprising side hydrocarbon chains with 18 to 40 carbon atoms and an average molecular weight ranging from 10,000 to 19,000.

According to another object, the invention relates to a hydrocarbon distillate comprising from 0 to 5,000 ppm of sulfur, and containing from 10 to 5,000 ppm of said composition according to the invention, optionally mixed with other additives, detergents, dispersants, de-emulsifiers, anti-foam agents, biocide agents, reodorant agents, cetane enhancers, anticorrosion agents, friction modifiers, enhancers of lubricity, combustion, cloud point, flow point, anti-sedimentation and conductivity. Preferably, the distillate comprises at least one hydrocarbon cut derived from the group formed by distillates with a boiling temperature comprised between 150 and 450° C., with an onset crystallization temperature Tcc greater than or equal to −5° C., preferably comprised between −5° C. and +10° C., comprising the distillates from direct distillation, in vacuo distillates, hydrotreated distillates, distillates from catalytic cracking and/or hydrocracking of distillates in vacuo, distillates resulting from ARDS type conversion and/or viscosity breaking methods, distillates derived from valuation of Fischer Tropsch cuts, distillates resulting from BTL conversion of vegetable and/or animal biomass, either taken alone or as a combination, and esters of vegetable and animal oils or their mixtures.

Preferably, the distillate comprises a content of n-paraffins containing more than 18 carbon atoms larger than 4% by weight. Preferably, the distillate comprises a content larger than or equal to 0.7% by weight of n-paraffins, the carbon number of which is greater than 24. Preferably, the distillate comprises from 0.7-2% of n-paraffins with a carbon number ranging from $C_{24}$ to $C_{40}$.

According to another object, the invention relates to a diesel fuel comprising 0 to 500 ppm of sulfur comprising at least one distillate according to the invention. According to another object, the invention relates to a heating fuel oil comprising from 0 to 5,000 ppm of sulfur comprising at least one distillate according to the invention. According to another object, the invention relates to a heavy fuel oil comprising at least one distillate according to the invention. The invention applies to distillates which may be used as diesel fuel or heating fuel oil further called domestic fuel oils. These distillates have an onset crystallization temperature or Tcc larger than or equal to −5° C., preferably comprised between −5° C. and +10° C. This temperature Tcc is measured by DSC, this technique allowing determination of the temperature at which the first paraffin crystals form, the latter generally corresponding to normal paraffins, with a chain length greater than or equal to 18 carbon atoms, paraffins with more than 24 carbon atoms being the first to crystallize when the temperature decreases.

The advantage of the present invention lies in the synergic effect of the use of so-called "revealing" compounds according to the invention, revealing the efficiency of conventional filterability or LFT additives as regards reduction in the filterability temperature of these hydrocarbon distillates resistant to the action of conventional filterability additives used alone. In this way, the invention is particularly directed to the use of a revealing compound of the homopolymer type in a hydrocarbon distillate comprising a weight content of n-paraffins containing more than 18 carbon atoms larger than 4%. More particularly, the hydrocarbon distillate comprises a weight content of n-paraffins larger than or equal to 0.7%, the carbon number of which is greater than 24. Preferably, the distillate is a cut with a boiling temperature comprised between 150 and 450° C., and comprises a mixture from 0.7 to 2% by weight of n-paraffins having a carbon number ranging from $C_{24}$ to $C_{40}$.

The filterability additives of the invention are copolymers or terpolymers of ethylene containing more than 20% of ester units. These units are of the vinyl acetate, vinyl propionate, vinyl versatate, (alkyl)acrylate, and (alkyl)methacrylate type, the alkyl group containing from 1 to 7 carbon atoms. The preferred filterability additives are selected from copolymers of ethylene and vinyl acetate, and/or of vinyl propionate and/or vinyl versatate, and/or of (alkyl)acrylates, and/or (alkyl)methacrylates, either taken alone or as a mixture, comprising from 20 to 40% by weight of ester units. Preferably, the filterability additives used in the invention are copolymers or terpolymers with a weight molecular weight comprised between 5,000 and 20,000. These copolymers or terpolymers have ester contents comprised between 20% and 40%.

The additives revealing the efficiency of filterability additives according to the invention are homopolymers obtained by polymerization of an olefinic ester of acrylic acid optionally substituted with an alkyl group having 1 to 7 carbon atoms, and of an alcohol comprising more than 16 carbon atoms, preferably from 18 to 50 carbon atoms. The homopolymer has a weight average molecular weight Mw comprised between 5,000 and 20,000 and preferably comprised between 10,000 and 19,000. Preferably, the homopolymer is a polyacrylate comprising side hydrocarbon chains with from 18 to 40 carbon atoms.

The efficiency of the revealing compound varies according to its weight molecular mass, to the chain length of the alcohol and to the nature of the carboxylic acid used for synthesizing the ester. The homopolymers according to the invention for revealing the efficiency of conventional filterability LFT additives are selected from a set of polyacrylates useful for improving the flow point of the easy-to-treat distillates. However, they are not efficient for revealing a synergy effect with conventional LFT additives.

The distillates at which the invention is aimed are selected from distillates with a boiling temperature comprised between 150 and 450° C. and with an onset crystallization temperature larger than or equal to −5° C., preferably comprised between −5° C. and +10° C., comprising the distillates from direct distillation, in vacuo distillates, hydrotreated distillates, distillates stemming from catalytic cracking and/or hydrocracking of distillates in vacuo, distillates resulting from ARDS type conversion and/or viscosity breaking methods, distillates from valuation of Fischer Tropsch cuts, and distillates resulting from BTL conversion of vegetable and/or animal biomass, and distillates containing alkyl esters of vegetable or animal oils and/or their mixture.

Another object of the invention is a synergic composition of additives dedicated to distillates with a boiling temperature comprised between 150° C. and 450° C., at an onset crystallization temperature close to zero, notably comprised between −5 and +10° C. This synergic composition comprises a mixture consisting of a filterability additive and of a homopolymer according to the invention in a ratio producing a synergic effect as regards the filterability temperature LFT of the distillates according to the invention, LFT being measured according to the NF EN116 standard. More particularly this composition comprises 85 to 99% by weight of at least one filterability additive based on a copolymer or terpolymer of ethylene and of a vinyl ester of a carboxylic acid with 3 to 5 carbon atoms and of a monoalcohol comprising from 1 to 10 carbon atoms, and from 1 to 15% by weight of a homopolymer of an olefinic ester of a carboxylic acid with 3 to 12 carbon atoms and of a fatty alcohol comprising more than 16 carbon atoms.

In this composition, the homopolymer has a weight average molecular weight Mw comprised between 5,000 and 20,000, preferably comprised between 10,000 and 19,000. It is an olefinic ester of acrylic acid with an alcohol comprising from 18 to 50 carbon atoms. Preferably, the homopolymer is a polyacrylate comprising side hydrocarbon chains with from 18 to 40 carbon atoms.

The filterability additives suitable for said composition according to the invention are selected from copolymers and terpolymers of ethylene containing more than 20% of ester units, these ester units being themselves selected from esters of the vinyl acetate, vinyl propionate, (alkyl)acrylate and (alkyl)methacrylate type, the alkyl group containing from 1 to 7 carbon atoms. Preferably, these filterability additives are selected from copolymers or terpolymers of ethylene and vinyl acetate, and/or vinyl propionate, and/or vinyl versatate, of ethylene and/or (alkyl)acrylates, and/or (alkyl) methacrylates, comprising from 20 to 40% by weight of ester units. These polymers or terpolymers have a weight molecular mass comprised between 3,000 and 20,000. In a preferred embodiment of the invention, the composition will comprise from 85% to 98% by weight of ethylene and vinyl acetate copolymers comprising from 25 to 30% by weight of vinyl acetate units and from 2 to 15% by weight of polyacrylate comprising side hydrocarbon chains with from 18 to 40 carbon atoms and with an average molecular weight ranging from 10,000 to 19,000.

Another object of the invention relates to the hydrocarbon distillate, for which the sulfur content is comprised between 0 to 5,000 ppm and which comprises from 10 to 5,000 ppm of said composition, optionally mixed with other additives, detergents, dispersants, de-emulsifiers, biocidal agents, antifoam agents, reodorant agents, cetane enhancers, anticorrosion agents, friction modifiers, enhancers of lubricity, combustion, cloud point, flow point, antisedimentation and conductivity. This distillate according to the invention comprises a major portion of at least one hydrocarbon cut having an onset crystallization temperature Tcc greater than or equal to −5° C., preferably comprised between −5° C. and +10° C., stemming from the group formed by distillates with a boiling temperature comprised between 150° C. and 450° C. comprising the distillates from direct distillation, in vacuo distillates, hydrotreated distillates, distillates stemming from catalytic cracking and/or hydrocracking of distillates in vacuo, the distillates resulting from ARDS type conversion and/or viscosity breaking methods, distillates stemming from valuation of Fischer Tropsch cuts, distillates resulting from BTL conversion of vegetable and/or animal biomass, taken alone or as a combination, and esters of vegetable and animal oils or their mixtures. These distillates comprise a content of n-paraffins containing more than 18 carbon atoms, larger than 4% by weight, and preferably larger or equal to 0.7% by weight of n-paraffins, the carbon number of which is greater than 24. The distillates particularly reactive to said composition comprise in their chemical composition from 0.7 to 2% of n-paraffins having a carbon number ranging from 24 to 40, the n-paraffin distribution may be continuous or discontinuous, i.e. all the families of n-paraffins are present or some are absent, thereby forming discontinuities notably when mixtures of distillates are made.

The invention is also directed to a combustion fuel, a fuel comprising from 0 to 500 ppm sulfur and/or a domestic fuel oil comprising from 0 to 5,000 ppm of sulfur or further a heavy fuel oil used as a combustion fuel in marine engines and in industrial boilers, these products containing a major portion of hydrocarbon base formed by at least one distillate according to the invention and a corresponding minor portion of 50 to 5,000 ppm of a synergic composition of additives using a revealing compound according to the invention. This composition of additives may be present in the fuel or combustion fuel with at least one additive from the group formed by additives, detergents, dispersants, de-emulsifiers, biocidal agents, antifoam agents, reodorant agents, cetane enhancers, anticorrosion agents, friction modifiers, enhancers of lubricity, combustion, cloud point, flow point, antisedimentation and conductivity.

DETAILED DESCRIPTION

With the purpose of illustrating the advantages of the present invention, examples are given as non-limiting examples.

Example 1

This example describes the nature of the components of the invention and comparative compounds. The distillates according to the invention resistant to filterability or LFT (CFPP) additives alone are called Fi and the distillates non-resistant to these additives are called Gi. They are described in the Table I hereafter.

TABLE I

| | G1 | G2 | F1 | F2 | F3 |
|---|---|---|---|---|---|
| % of normal paraffins* | | | | | |
| $<C_{13}$ | 4.53 | 2.86 | 2.05 | 1.77 | 0.41 |
| $C_{13}$-$C_{17}$ | 8.61 | 7.44 | 4.58 | 4.2 | 4.26 |
| $C_{18}$-$C_{23}$ | 5.47 | 4.02 | 4.64 | 4.31 | 9.38 |
| $>C_{24}$ | 0.66 | 0.24 | 0.94 | 0.8 | 1.5 |
| Total of n-paraffins | 19.27 | 14.56 | 12.21 | 11.08 | 15.56 |
| LFT (° C.) | −4 | −8 | 1 | 0 | 7 |
| FT (° C.) | −12 | −15 | −6 | — | 6 |
| CPT (° C.) | −4 | −7 | 2 | 0 | 7 |
| Density | 0.8327 | 0.8414 | 0.8541 | 0.863 | 0.870 |
| Sulfur in ppm | 39.8 | 320 | 930 | 1240 | 1950 |
| Viscosity at 40° C. $mm^2/s$ | 2.725 | 2.752 | 2.6348 | — | — |
| Cetane as calculated | 50.1 | 50.2 | 44.8 | — | — |

TABLE I-continued

| | G1 | G2 | F1 | F2 | F3 |
|---|---|---|---|---|---|
| according to ASTM D4737 IP391 aromatic content | | | | | |
| Monoaromatics % | 22.7 | 23 | 26.6 | 27.6 | — |
| Diaromatics in % | 6.2 | 5.5 | 9.1 | 8.2 | — |
| Polyaromatics in % | 0.6 | 1.2 | 1.9 | 3.3 | — |
| TCC (° C.) | −7/−6.2 | −8.3 | −1.2 | −1.2 | 5 |
| D86 distillation (° C.) | | | | | |
| Initial point | 167.6 | 176.8 | 156.4 | 162.6 | 164.1 |
| T10 | 203 | 207.6 | 189.8 | 195.5 | |
| T20 | 224.7 | 225.6 | 203.5 | 220.7 | |
| T50 | 274.5 | 270.7 | 271.9 | 293.6 | |
| T80 | 317.1 | 314.1 | 331.3 | 341 | |
| T90 | 337.4 | 333.2 | 354.3 | 357 | 360 |
| T95 | 353.9 | 345.9 | 371.1 | 372 | |
| Final point | 356 | 352.2 | 373.4 | 382.8 | |

*% by weight of paraffins determined by liquid chromatography/gas chromatography coupling FT = Flow temperature LFT = Filterability temperature CPT = Cloud point temperature as measured by ASTM D2500 or EN 23015

TCC = Onset crystallization temperature as measured by Differential Scanning Calorimetry Analysis (ACD or DSC) or according to IP 389-93.

The FT temperature or flow point measured for distillates used as fuels is the lowest temperature at which the hydrocarbon is still able to flow. The CPT or cloud point temperature is a visual appreciation of the germination and crystallization of paraffins, this measurement is less accurate than that of the onset crystallization temperature Tcc. The LFT, the limiting filterability temperature of crystals of paraffins precipitating in hydrocarbons at low temperature, is intermediate between both of these extreme temperatures FT and Tcc: it is intended for appreciating the temperature at which the size of the crystals is still sufficiently small for not blocking the filters.

Generally, the respective variations of LFT, FT and Tcc are not necessarily related to each other and are more often dependent on the chemical composition of the products. Examples of distillates F1, F2, F3 according to the invention have an n-paraffin content greater than or equal to 0.7% and a Tcc>−5° C., while distillates G1, G2 have an n-paraffin content less than 0.7% and Tcc<−5° C. The distribution of the paraffins is determined by liquid/gas chromatography. With this method it is possible to determine the C9-C30 n-paraffin concentration in middle distillates.

In a first step, with liquid chromatography, it is possible to separate the middle distillate according to chemical families (saturated, mono-, di- and tri-aromatic families). As the n-paraffins are in the saturated fraction, the latter is recovered and injected on a gas chromatography column where the paraffins are separated according to their boiling temperature and therefore to their carbon number. Finally, the paraffins are quantified by calibration.

The filterability additives used are copolymers of ethylene and vinyl acetate referenced hereafter as EVAi in Table II hereafter.

TABLE II

| | Viscosity at 100° C. (Pa · s) | Vinyl acetate content (weight %) | Molecular weight Mw |
|---|---|---|---|
| EVA 1 | 0.3 | 28 | 9,500 |
| EVA 2 | 0.4 | 31 | 15,000 |
| EVA 3 | 0.4 | 36 | 18,000 |
| EVA 4 | 0.3 | 24 | 10,000 |

The revealing compounds used are polyacrylates referenced as Bi, the characteristics of which are given for 30% of active materials in an aromatic solvent of the Solvarex 10 type (aromatic hydrocarbon cut with 8 to 20 carbons and a boiling point varying from 140 to 320° C.) in Table III hereafter. As preparation examples, these polyacrylates are obtained by polymerization of the monomer under an inner nitrogen atmosphere as follows.

100 parts of this monomer are melted beforehand in an oven at 70° C. and then solubilized in 158 parts of aromatic solvent (Solvarex 10 or Solvarex 150). The obtained mixture is continuously introduced for 6 hrs 30 and under stirring in a tank under a nitrogen atmosphere containing 75 parts by weight of aromatic solvent and 4 parts by weight of organic peroxide, this mixture having been raised beforehand to a temperature of 100° C. Throughout the addition, the set temperature is maintained at 100° C. The reactor is cooled and the resin is stabilized by adding 100 ppm of 4-methoxyphenol, in order to avoid post-polymerization of the residual monomers which may lead to a change in the average molar mass of the polymers during storage.

TABLE III

| | Monomer | Acid content (mg KOH/g) | Density at 20° C. (kg/L) | Viscosity at 20° C. (mm/s) | Viscosity at 40° C. (mm/s) | Mw, Mn by CPG (daltons) |
|---|---|---|---|---|---|---|
| B1 | $C_{18}/C_{22}$ acrylate | 1.5 | 0.895 | 15 | 5,000 | 15,000 |
| B2 | $C_{30}/C_{40}$ acrylate | 0.5 | Not measurable | Solid | Solid | 6,770 |

Example 2

The present invention aims at showing the benefit of Bi revealing compounds according to the invention and their influence on the efficiency of LFT additives on distillates Fi of the invention and on Gi distillates. Table IV gathers the results obtained by comparing the efficiency of B1, either alone or in combination with the LFT additives EVA 1 and EVA 2 on the Fi and Gi distillates.

TABLE IV

| | Amount in ppm | G1 | G2 | F1 | F2 | F3 |
|---|---|---|---|---|---|---|
| Distillate alone | | −4 | −8 | 1 | 0 | 7 |
| Tcc | | −7 | −8.3 | −1.2 | −1.2 | 5 |
| EVA 1 | 100 | −7 | −10 | −7 | 1 | 7 |
| | 200 | −13 | −10 | −11 | 3 | 7 |
| | 300 | −13 | / | / | 4 | 7 |
| EVA 2 | 100 | −8 | −9 | 4 | 3 | / |
| | 200 | −11 | −17 | 3 | 2 | / |
| EVA1/B1 | 100 | −8 | −9 | −11 | / | / |
| 95.5/4.5 | 200 | −11 | −10 | −10 | −6 | −7 |
| | 300 | −14 | / | / | −8 | −10 |
| EVA2/B1 | 100 | / | −10 | / | / | / |
| 95.5/4.5 | 200 | / | −19 | / | −6 | −10 |
| B1 | 4.5 | −4 | −8 | 1 | 0 | 7 |
| | 9.5 | −4 | −8 | 1 | 1 | 8 |

It is observed that the Fi distillates with Tcc greater than −5° C. are not or not very reactive to EVAi alone but are reactive to synergic mixtures EVAi/Bi while the Gi distillates outside the invention with Tcc less than −5° C. are only reactive to the EVA alone. It is to be noted that the revealing compound B alone does also not show any LFT efficiency on either of the families of Fi or Gi distillates.

Example 3

The present example describes the influence of the relative concentration of the revealing compounds Bi and of the LFT additives EVAi on the reduction of LFT temperatures of Fi distillates typical of the invention. Table V gathers the filterability temperatures of the distillates F1 and F2 when the concentration of the revealing compound Bi is varied for variable concentrations of the EVAi/Bi composition.

TABLE V

| F | | 0 ppm | 100 ppm | 200 ppm |
|---|---|---|---|---|
| F1 | EVA1 | 1 | −7 | −11 |
| F1 | EVA1/B1: 97.8/2.2 | 1 | −13 | −11 |
| F1 | EVA1/B1: 95.5/4.5 | 1 | −11 | −10 |
| F1 | EVA1/B1: 90/10 | 1 | −11 | −11 |
| G1 | EVA1 | −4 | −15 | −17 |
| G1 | EVA1/B1: 96/4 | −4 | −15 | −17 |
| G1 | EVA1/B1: 92/8 | −4 | −12 | −14 |
| G1 | EVA1/B1: 82/18 | −4 | −8 | −11 |

The conducted tests by varying the EVA1/B1 ratio show in the case of Fi distillates, an optimum efficiency for small doses of revealing compound. When taking Gi distillates, a loss of efficiency of the EVA1s is seen on the contrary with increasing concentration of revealing compounds Bi, expressed by an increase in the filterability temperature of the distillate.

Example 4

The present example describes the preferred polymers of the invention selected from the polymers of olefinic esters of carboxylic acids and of an alcohol. The question is of describing the impact of the nature of the carboxylic acid and that of the chain length of the alcohol on the decrease of the filterability temperature of the F1 and F2 distillates. In the composition according to the invention, the content of homopolymers of olefinic esters of carboxylic acids and of an alcohol is 4.5% for an EVA1 content of 95.5%. The composition content in the distillates varies from 0 to 300 ppm in the present example.

The obtained results are gathered in Table VI hereafter,

TABLE VI

| | Monomer used for synthesizing the revealing compound B | Mw (revealing compound) | 0 ppm | 200 ppm | 300 ppm |
|---|---|---|---|---|---|
| F2 | Without | — | 1 | 4 | 3 |
| F2 | B1 $C_{18}/_{22}$ acrylate | 13,370 | 1 | −6 | −6 |
| F2 | $C_{18-22}$ methacrylate | 17,100 | 1 | 3 | |
| F2 | $C_{16}$ stearyl methacrylate | 16,100 | 1 | 4 | |
| F2 | $C_{12}$ lauryl methacrylate | 11,985 | 1 | 3 | 2 |
| F2 | $C_{30}/_{40}$ acrylate | 6,764 | 1 | 0 | −7 |
| F2 | $C_{16}$ stearyl acrylate | 13,660 | 1 | 5 | 3 |
| F2 | $C_{12}$ lauryl acrylate | 14,030 | 1 | 3 | 4 |
| F1 | Without | — | 1 | −7 | −11 |
| F1 | B1 $C_{18-22}$ acrylate/ 2-ethyl-hexyl acrylate: 80/20 | 7,649 | 1 | 0 | −1 |
| F1 | B1 $C_{18-22}$/ 2-ethyl-hexyl acrylate: 50/50 | 7,555 | 1 | 0 | −2 |
| F1 | B1 $C_{18-22}$ acrylate/ vinyl acetate: 70/30 | 9,701 | 1 | 0 | −2 |
| F1 | B1 $C_{18-22}$/isobomyl acrylate: 70/30 | 8,382 | 1 | 0 | −1 |
| F1 | B1 $C_{18-22}$ acrylate | 8,000 | 1 | −11 | −10 |

The efficiency of the revealing compound varies depending on the chain length of the alcohol and on the nature of the carboxylic acid used for synthesizing the polyester. In Table VI above, efficiency tests were carried out with revealing compounds synthesized by homopolymerization of alkyl acrylates with a chain length varying from $C_{12}$ to $C_{40}$ (according to the operating procedure described in Example 1). These results clearly show that the positive effect of the revealing compound occurs for polymers consisting in majority of alkyl chains above $C_{16}$. Best results are obtained with $C_{18}$-$C_{22}$ acrylate and $C_{30}$-$C_{40}$ acrylate.

Other tests by replacing the revealing compound B1 with polymers synthesized by copolymerization of the $C_{18}$-$C_{22}$ acrylate with vinyl acrylate (ratio: 70/30) or with 2-ethyl-hexyl acrylate (ratio 80/20 and 50/50) show that these copolymers are not efficient as compared with the corresponding $C_{18}$-$C_{22}$ homopolymers. They even have a detrimental effect as regards the LFT temperature of the distillates according to the invention. The nature of the carboxylic acid is also a significant parameter, the tests described above carried out by replacing B1 with homopolymers of esters of $C_{12}$, $C_{16}$ or $C_{18}$-$C_{24}$ methacrylic acids show that they are not as efficient as their homologs obtained by homopolymerization of esters of acrylic acid. This example actually shows that the required selection of the polyacrylates of the invention as a revealing compound of the efficiency of the filterability additives on the filterability temperature of the distillates of the type of the invention is not obvious in view of the prior art. Only with the synergic combination of the composition according to the invention, the problem of lowering the LFT temperature of distillates with Tcc greater than or equal to −5° C. may be solved.

The invention claimed is:

1. A method of improving the activity of filterability additives, added to a hydrocarbon distillate, the method comprising:

adding a polyacrylate to a hydrocarbon distillate containing filterability additives, the filterability additives comprising a copolymer and/or terpolymer of ethylene and of a vinyl ester of a carboxylic acid with 3 to 5 carbon atoms and of a monoalcohol comprising 1 to 10 carbon atoms, the hydrocarbon distillate being resistant to the filterability additives, wherein the polyacrylate comprises side hydrocarbon chains with 18-40 carbon atoms, and the hydrocarbon distillate has a boiling temperature comprised between 150 and 450° C., an onset crystallization temperature as measured by differential scanning calorimetry analysis, greater than or equal to −5° C., and a weight content of n-paraffins containing more than 18 carbon atoms greater than 4%, wherein the polyacrylate cooperates synergistically with the filterability additives to increase the filterability of the hydrocarbon distillate, and wherein the polyacrylate is not a polymethacrylate.

2. The method according to claim 1, wherein the hydrocarbon distillate comprises a weight content greater than or equal to 0.7% of n-paraffins, the carbon number of which is greater than 24.

3. The method according to claim 1, wherein the distillate comprises a mixture of 0.7 to 2% by weight of n-paraffins having a carbon number ranging from $C_{24}$ to $C_{40}$.

4. The method according to claim 1, wherein the filterability additives are copolymers of ethylene containing more than 20% of ester units.

5. The method according to claim 1, wherein the filterability additives are selected from copolymers of ethylene and of vinyl acetate, of ethylene and vinyl propionate, of ethylene and vinyl versatate, of ethylene and (alkyl)acrylates, of ethylene and (alkyl)methacrylates, taken alone or as a mixture, comprising from 20 to 40% by weight of ester units.

6. The method according to claim 1, wherein said esters are of the vinyl acetate, vinyl propionate, vinyl versatate, (alkyl)acrylate and (alkyl)methacrylate type, the alkyl group containing 1 to 7 carbon atoms.

7. The method according to claim 1, wherein the homopolymer is obtained by polymerization of an olefinic ester of acrylic acid, and of an alcohol comprising from 18 to 50 carbon atoms.

8. The method according to claim 1, wherein the distillate is selected from the distillates with a boiling temperature comprised between 150 and 450° C. comprising the distillates from direct distillation, in vacuo distillates, hydrotreated distillates, distillates stemming from catalytic cracking and/or hydrocracking of distillates in vacuo, distillates resulting from ARDS type conversion and/or viscosity breaking methods, distillates stemming from valuation of Fisher Tropsch cuts, and distillates resulting from BTL conversion of vegetable and/or animal biomass, and distillates containing alkyl esters of vegetable or animal oils, taken alone or as a mixture.

9. The method according to claim 1, wherein the polyacrylate has an average molecular weight Mw comprised between 10,000 and 19,000.

10. The method according to claim 1, wherein the hydrocarbon distillate has an onset crystallization temperature as measured by differential scanning calorimetry analysis, greater than or equal to −1.2° C.

* * * * *